US006138412A

United States Patent [19]

Rieckmann et al.

[11] Patent Number: 6,138,412

[45] Date of Patent: Oct. 31, 2000

[54] DOOR OPENER AND CLOSER

[75] Inventors: William H. Rieckmann, Hillsboro, Oreg.; Wayne W. Bostad, deceased, late of Vancouver, Wash., by L. Marguerite Bostad, legal representative

[73] Assignee: Chase Industries, Inc., Cincinnati, Ohio

[21] Appl. No.: 08/842,994

[22] Filed: Apr. 25, 1997

[51] Int. Cl.[7] ..... E05F 11/24

[52] U.S. Cl. ..... 49/349; 49/340

[58] Field of Search ..... 49/340, 344, 346, 49/339, 139, 140

[56] References Cited

U.S. PATENT DOCUMENTS

| | | | |
|---|---|---|---|
| 1,314,023 | 8/1919 | Spencer | 49/346 |
| 3,269,061 | 8/1966 | Massina | 49/340 X |
| 3,864,875 | 2/1975 | Hewitt . | |
| 4,365,442 | 12/1982 | Speer . | |
| 4,735,018 | 4/1988 | Duncan et al. | 49/344 X |
| 5,392,562 | 2/1995 | Carámbula | 49/346 |

*Primary Examiner*—Jerry Redman
*Attorney, Agent, or Firm*—Robert L. Harrington

[57] ABSTRACT

A door opener and closer that provides motive power for opening and closing a door. A double acting cylinder pivotally mounted on the door is coupled to a roller arm. A roller on the roller arm is captive within a cage mounted to the door frame. The cylinder applies a force on the roller arm in one direction to open the door and in the opposite direction to close the door. The components are mounted in a manner such that none of the components project into the door opening. The door opener and closer eliminates the need for a separate closer. The door may be opened manually with minimum resistance.

4 Claims, 3 Drawing Sheets

DOOR OPENER AND CLOSER

FIELD OF THE INVENTION

This invention relates to an attachment to a door which functions to both open and close the door automatically primarily useful in industrial and commercial applications.

BACKGROUND OF THE INVENTION

Automatic door openers are common place in many types of commercial and industrial applications. For example, retail stores provide automatic door openers for customers entering and leaving with packages and or small children, and industrial businesses provide door openers for workers maneuvering forklift trucks between rooms and buildings closed off by doors and so on.

Typically, as a customer or worker approaches a door, a switch is engaged and the door opener is activated to open the door, held to the open position for a selected time period and then allowed or is initiated to close the door. A factor that needs to be considered in such a door opener design is safety. For example, if there is a power failure (such doors being operated by some form of power), there needs to be some provision that allows manual operation of the door. Other factors include appearance, appropriate interfit with conventional doors and door support structures and cost.

An example of a door opener that satisfies each of the criteria expressed above is the commonly owned U.S. Pat. No. 4,356,442. This patent discloses a pneumatic operated door opener that provides a pushing element at the end of a lever that engages one side of the door, the lever being connected to a pneumatic motor that is actuated by remote control. When actuated, the lever supplies force to the side of the door to push the door open. A separate door closer acting on the opposite side of the door closes the door upon release of the pneumatic power. This door opener has the advantage of being easily mounted without concern for perfect alignment of pivotal axes as between the door and the opener, it is low cost and it provides no resistance to manual opening of the door.

The present invention is believed to provide improvements over this door opener in that it eliminates the separate door closer while retaining the ability to manually open and close the door. Other advantages will be disclosed and/or apparent from the following disclosures.

BRIEF DESCRIPTION OF THE INVENTION

The present invention provides a pusher element on a door opening lever that is actuated by a motor, preferably a pneumatic motor. The pusher element is trapped in an elongated cage that allows relative movement of the pusher element along the length of the cage and not laterally. The cage is fixedly secured either on a side of the door with the motor installed on the door frame, or vice versa, i.e., with the motor installed on the door and the cage fixedly secured to the door frame. The motor is arranged to be actuated in either direction, e.g., a two-way pneumatic motor that actuates the lever and pushing element thereon to push against one side of the cage to open the door and when reversed to push against the other side of the cage to close the door.

The separate door closer is eliminated. The pusher element when moving back and forth along the cage length is not required to follow an exact track and in the same manner as the '442 patent, the pivotal action of the lever and motor versus the door does not require exact alignment there between. The resistance to manual opening, i.e., forcing the piston of the pneumatic motor to move within the cylinder without power actuation is so slight as to allow easy manual opening of the door. The alternate attachment allows the user to select between having the motor and lever mounted on the door and thereby avoiding any restriction in the door opening, or mounted on the door frame which requires some projection into the door opening but leaves the door free of projecting mechanism. One or the other may be preferred depending on the use and actuation of the door.

The invention and its advantages will be more fully appreciated upon reference to the following detailed description having reference to the accompanied drawings.

DESCRIPTION OF THE PREFERRED EMBODIMENT

Figure 1:
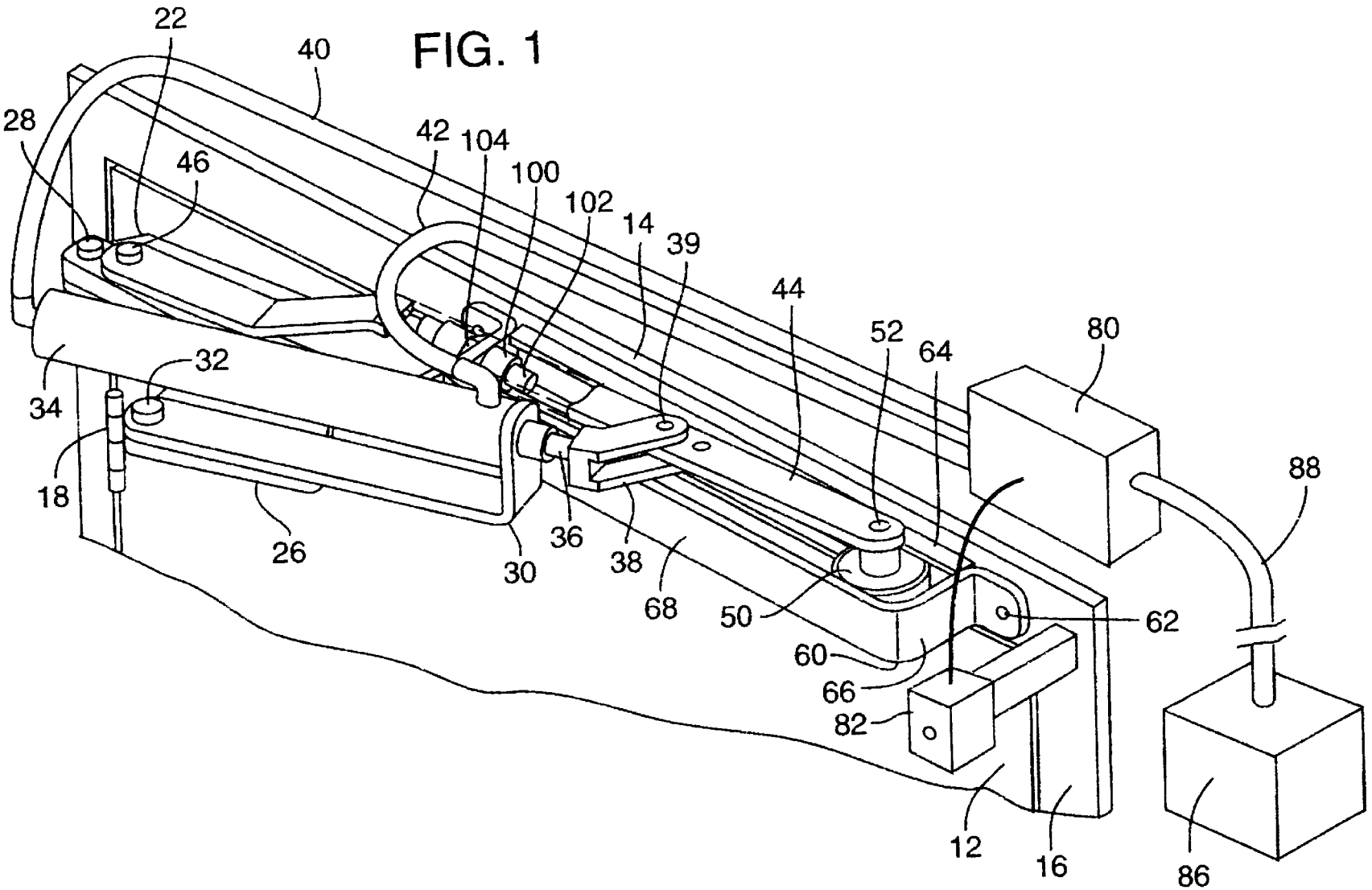
FIG. 1 is a view of a door opener and closer mounted on a door and door frame.
Figure 2:
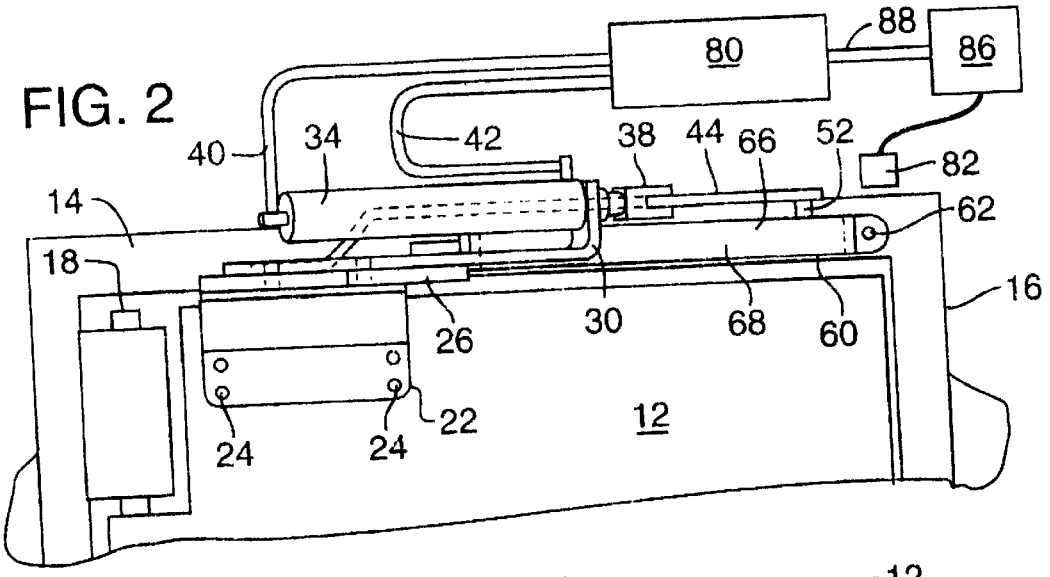
FIG. 2 is a another view of the door opener and closer of FIG. 1.
Figure 3:
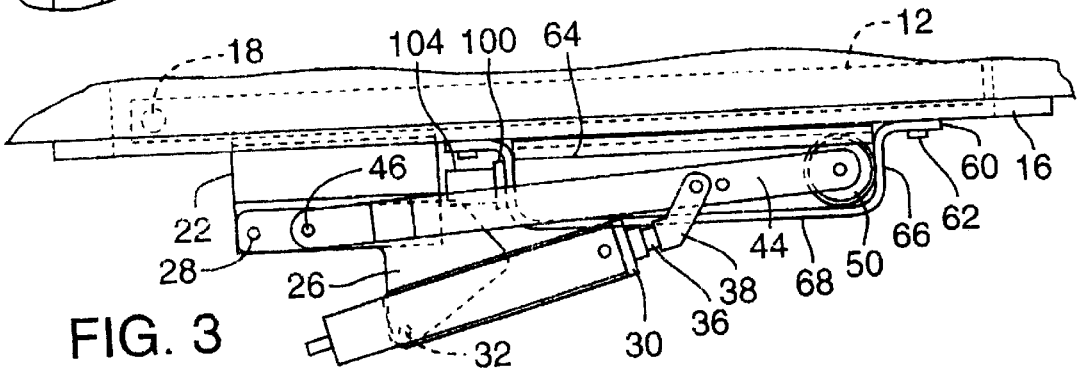
FIG. 3 is a top view of the door opener and closer of FIG. 1.
Figure 4:
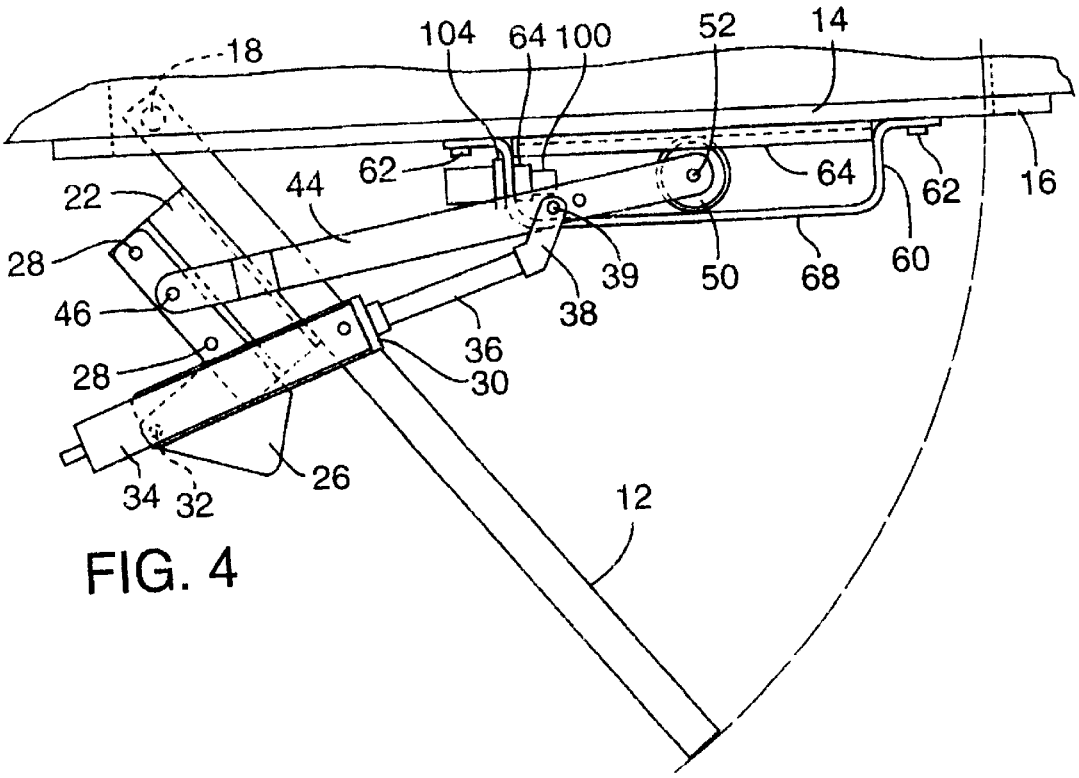
FIG. 4 is a view similar to FIG. 3 showing the door partially opened by the door opener and closer.

Refer now to FIG. 1 of the drawings in conjunction with FIGS. 2–4 which illustrate a door opener and closer of the present invention mounted to a door 12 and frame 16. The door 12 is mounted on the door frame 16 by hinges 18. Two types of hinges 18 are illustrated in the figures. One type is illustrated in FIG. 1 and another in FIGS. 2–6. The hinges define an axis of pivot for the door 12 and the door 12 is pivotally movable on the hinges 18 between an opened and a closed position. In this embodiment a door opener and closer is mounted strategic to the door 12 and the frame 16 to provide motive power to automatically open and close the door 12. The door opener and closer is also arranged to permit the door 12 to be opened manually.

Figure 5:
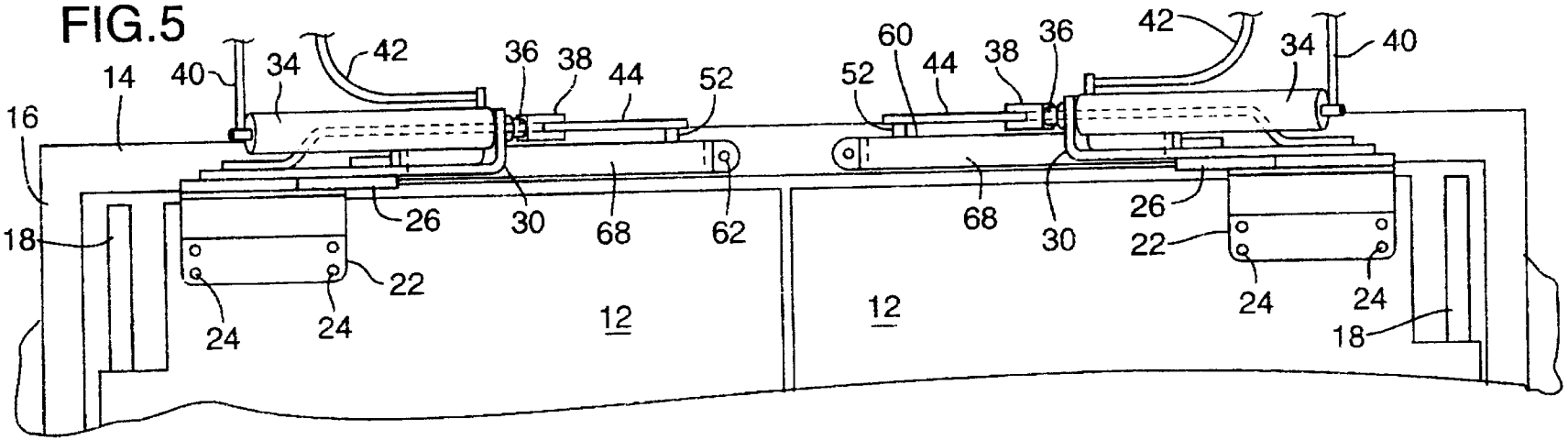
FIG. 5 is a view of the door opener and closer applied to double doors; and, FIG. 6 is a view illustrating another mounting arrangement of the door opener and closer.

The door opener and closer is mounted to the door 12 and the frame 16 in a manner such that the door opener and closer does not project into nor provide any obstruction in the opening of the frame 16 when the door is in the opened position. The following has reference to a single door as illustrated in FIGS. 1–4, however it is applicable to a pair of doors 12 as illustrated in FIG. 5.

The door opener and closer has a bracket 22 mounted to the upper portion of the door 12 by conventional fasteners 24 (best seen in FIG. 2). The bracket 22 is arranged to receive and support a pivot bracket 26. The pivot bracket 26 is mounted to the bracket 22 by fasteners 28 (see FIG. 3). A cylinder support bracket 30 is pivotally mounted to the pivot bracket 26 on a pivot pin 32 with the cylinder bracket 30 supporting an air cylinder 34. It will be appreciated that the brackets 22, 26 may be formed as an integral unit.

The cylinder 34 has a cylinder (piston) rod 36 that is extendable and retractable by the application of air pressure in a conventional manner. A clevis type coupling 38 is mounted on the end of the cylinder rod 36. The coupling 38 is pivotally mounted to and at a position between the ends of a roller arm lever 44 by a pin 39. The lever 44 is received in the clevis portion of the coupling 38. One end of the roller arm lever 44 is pivotally mounted to the pivot bracket 26 by a pivot pin 46. The other end of the roller arm lever 44 has a roller 50 rotatably mounted on a shaft 52.

A cage 60 is mounted to the cross member (header) 14 of the door frame 16 by fasteners 62. The cage 60 is mounted strategic to the components of the door opener and closer mounted on the door 12 and is arranged to receive the roller 50. The cage 60 has a flat member 64 that lies flat against the member 14 of the frame 16 and has a U-shaped member 66 that extends outwardly from the member 64. The flat member 64 and the U-shaped member 66 in combination form a cage to receive the roller 50. The U-shaped member 66 has a flat portion 68 that is substantially parallel to the flat member 64 with the flat member 64 and the flat portion 68 defining opposed sides of the cage 60. During operation of the opener and closer, the roller 50 will traverse within the cage 60 between the flat member 64 and the flat portion 68 of the U-shaped member 66.

Air lines 40 and 42 are coupled to the air cylinder 34 with the air lines 40, 42 being connected to a known controller 80. Air is supplied to the controller 80 by an air source such as a compressor 86 by air line 88. The controller 80 is arranged to direct air pressure selectively through the air lines 40, 42. When air pressure is applied to air line 40, air will flow into the cylinder 34 and force the piston rod 36 to extend outwardly from the cylinder 34. When air pressure is applied to the air line 42, the cylinder rod 36 will be forced inwardly into the air cylinder 34.

The controller 80 is actuated by known switches (and/or sensors) 82 that will provide a signal for the controller to activate the door opener and closer. The controller 80 further will control the dwell times. That is, it will control the time the door is held in an open position before the cycle is reversed and the door is closed.

When the door 12 is in the closed position and a signal from a switch 82 (or sensor) is sent to the controller 80, the controller 80 will apply air pressure to line 40. The pressure applied to line 40 and thus the cylinder 34 will force the cylinder rod 36 to move outwardly out of the cylinder (see FIG. 4). The bracket 38 on the end of the cylinder rod 36 is connected to the roller arm lever 44 and an end of the lever 44 is connected to the pivot bracket 26. The extension of the cylinder rod 36 will exert a force on the roller 50 and the pivot bracket 26 to cause the door 12 to pivot on the hinges 18 to pivot the door to an open position. The roller 50 will be forced against the member 64 of the cage 60 and will travel within the cage 60. The extension of the cylinder rod 36 in effect lengthens one side of a triangle, the triangle being defined by the pins 32, 39, and 46. The extension of the cylinder rod 36 thus lengthens the side of the triangle between pins 32, 39. The lengthening of the side of the triangle by the extension of the rod 36 forces the roller 50 against the member 64 mounted to the fixed header 14. The extension of the rod 36 will thus provide an urging force against the bracket 26 affixed to the door by bracket 22 to cause the door 12 to pivot on the hinges 18 as illustrated in FIG. 4.

When the door 12 is in the open position, the door 12 is most often held in that position for a short period of dwell time. After the dwell time has elapsed, the controller 80 will apply pressure to line 42 to force the cylinder rod 36 to retract into the cylinder 34. The valve in the controller 80 which controls air to air line 40 is opened so that air may escape via line 40. As the cylinder rod 36 is retracted, the roller 50 will be forced against the flat portion 68 of the cage 60. Since the cage 60 is in a fixed position, the retraction of the cylinder rod 36 will cause the door 12 to pivot on the hinge 18 toward the closed position. During the pivoting of the door 12, the roller 50 will travel within the cage 60.

When necessary, the door 12 may be opened manually without the assistance of the door opener and closer mounted to the door 12 and frame 16. The door 12 is simply opened in a conventional manner by forcing the door toward the open position. As the door 12 is manually forced toward the open position, the pivoting action of the door will cause the cylinder rod 36 to extend out of the cylinder 34. The air within the cylinder 34 (and air line 42) is compressed by the extension of the cylinder rod 36. A relief valve releases the air to atmosphere upon reaching a pre-determined pressure. The compression of the air will provide a resistance that is similar to that of a conventional door closing mechanism.

FIG. 5 illustrates the arrangement of a door opener and closer as applied to each of a pair of doors 12. The door openers and closers as illustrated in FIG. 5 operate in the same manner as the door opener and closer illustrated in FIGS. 1–4 with each door opener and closing mechanism coupled to the controller 80. The controller 80 will control the door openers and closers to simultaneously open and close the doors 12. Either or both of the doors 12 may also be opened manually with the door opener and closer providing minimum resistance to opening the doors.

Figure 6:
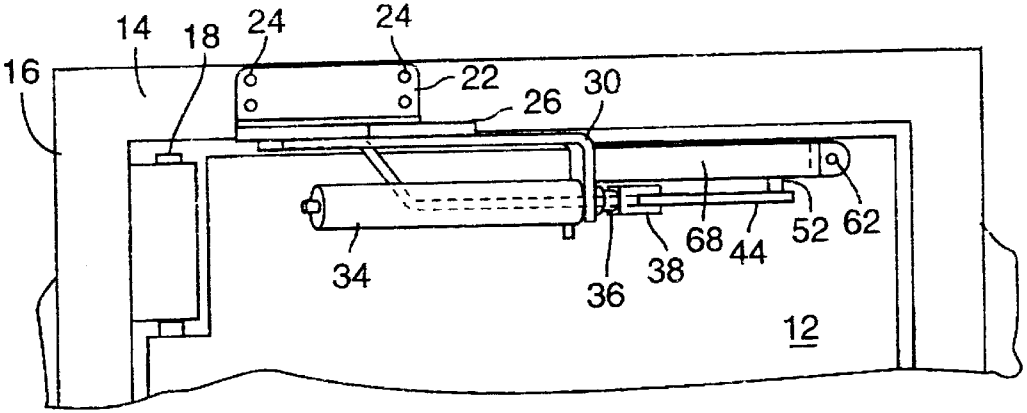

FIG. 6 illustrates the reverse mounting of the door opener and closer in the frame 16 and the door 12. As shown, the cage 60 is mounted to the door rather than to the header 14 and the balance of the door opener and closer is mounted to the header instead of on the door 12.

The arrangement of the cage 60 also provides for mounting a positive door stop for stopping the door 12 as it is opened to its fully opened position. The door stop 100, as best seen in FIGS. 1 and 4, is mounted on an end of the U-shaped member 66. The door stop 100 has an adjustable screw type plunger 102 that may be adjusted for length within the door stop 100. The plunger 102 is locked in position by a nut 104. Referring to FIG. 4, the roller 50 as the door 12 is opened to its fully opened position will have the roller traveling in the cage 60 and the roller 50 will come into contact with the plunger 102. The roller 50 when it comes into contact with the plunger 102 will stop the motion of the door 12. The positive door stop 100 thus eliminates the necessity of providing an external stop for the door 12.

Those skilled in the art will recognize that modifications and variations may be made without departing from the true spirit and scope of the invention. For example, whereas the preferred embodiment relies on overcoming the air pressure to achieve, e.g., the emergency manual opening, such may not be adequate for all pneumatic openers or other than pneumatic openers such as hydraulic or electric openers. In those cases, a connection between the door and opener can be provided with a break away feature such as a shear pin. Also, although not discussed, the door installer may provide different forms of door stops at both the closed and opened positions. These are but a few of the modifications that may be made. The invention is therefore not to be limited to the embodiments described and illustrated but is to be determined from the appended claims.

What is claimed is:

1. In combination, an opener and closer device for opening and closing a door hingedly connected to a frame adjacent a door opening into and from which the door is closed and opened, said opener and closer device comprising:

a lever pivotally mounted at one end to one of the door and frame and having a pusher element at the opposite end, a cage having a length and width defining opposed sides and secured to the other of the door and frame, said pusher element trapped inside the cage, the cage configured to permit movement of the pusher element within the cage along the cage length with the pusher element confined laterally by the cage width;

a motor including a rod powered into and out of a cylinder, said motor connected to the lever and to a designated anchor position whereby powering the rod into and out of the cylinder causes the pushing element to automatically push against one side and then the other side of the cage and thereby urge opening and closing of the door.

2. An opener and closer device as defined in claim 1 wherein the motor is a pneumatic powered motor provided with a given power force, the power force being adequate to open and close the door when unobstructed and being readily overpowered to provide for opening and closing of the door manually.

3. An opener and closer device as defined in claim 2 wherein the pivotal mounting of the lever and anchor position for the motor are provided on the door and carried by the door to the opened position and thereby exposing the entire door opening for passage there through.

4. An opener and closer device as defined in claim 3 wherein a roller is provided on the lever end as the pusher element.

* * * * *

UNITED STATES PATENT AND TRADEMARK OFFICE

CERTIFICATE OF CORRECTION

PATENT NO. : 6,138,412
DATED : October 31, 2000
INVENTOR(S) : Rieckmann

It is certified that error appears in the above-identified patent and that said Letters Patent is hereby corrected as shown below:

Change title from "DOOR OPENER AND CLOSER" to --DOOR OPENER--.

Signed and Sealed this

Twelfth Day of June, 2001

Nicholas P. Godici

*Attest:*

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,138,412
DATED : October 31, 2000
INVENTOR(S) : Rieckmann

It is certified that error appears in the above-identified patent and that said Letters Patent is hereby corrected as shown below:

Change title from "DOOR OPENER AND CLOSER" to --DOOR OPENER--.

Signed and Sealed this

Twenty-sixth Day of June, 2001

Nicholas P. Godici

*Attest:*

*Attesting Officer*

NICHOLAS P. GODICI
*Acting Director of the United States Patent and Trademark Office*